US005771615A

United States Patent [19]

Welldon et al.

[11] Patent Number: 5,771,615

[45] Date of Patent: Jun. 30, 1998

[54] ANIMATED DISPLAY ASSEMBLY

[75] Inventors: Kenneth George Welldon, Capalaba; Kenneth John Thornton, Wynnum; Colin John Staples, Cleveland; Keith Michael Daly, Victoria Point; Rodney David Davidson, Wynnum West, all of Australia

[73] Assignee: 3D Displays Pty. Ltd., Capalaba, Australia

[21] Appl. No.: 624,441

[22] PCT Filed: Oct. 7, 1994

[86] PCT No.: PCT/AU94/00611

§ 371 Date: Apr. 1, 1996

§ 102(e) Date: Apr. 1, 1996

[87] PCT Pub. No.: WO95/10105

PCT Pub. Date: Apr. 13, 1995

[30] Foreign Application Priority Data

| | | | |
|---|---|---|---|
| Oct. 7, 1993 | [AU] | Australia | PM 1675 |
| Jan. 20, 1994 | [AU] | Australia | PM 3466 |

[51] Int. Cl.[6] ..... G09F 19/00

[52] U.S. Cl. ..... 40/406

[58] Field of Search ..... 40/406, 409, 427

[56] References Cited

U.S. PATENT DOCUMENTS

| | | | |
|---|---|---|---|
| 2,667,001 | 1/1954 | Sheridan | 40/406 |
| 4,631,210 | 12/1986 | McGee | 40/406 X |
| 5,075,992 | 12/1991 | Kahn . | |
| 5,109,620 | 5/1992 | Torrence . | |

FOREIGN PATENT DOCUMENTS

| | | | |
|---|---|---|---|
| 304245 | 2/1989 | European Pat. Off. . | |
| 2261581 | 10/1975 | France . | |
| 1155665 | 10/1963 | Germany | 40/406 |
| 2451606 | 5/1975 | Germany . | |
| 2040531 | 8/1980 | United Kingdom . | |

OTHER PUBLICATIONS

'81 Patent Abstract of Japan, M–85, p. 162, JP,A, 56–70986 (Honshiyuu Seishi K.K.).

Colour Index (third edition), vol. 5, The Society of Dyers and Colourists pp. 5838–5839; and vol. 3, pp. 3578–3579, 3594–3595 and 3624–3625.

'90 Patent Abstract of Japan, P–1110, p. 55, JP, A, 2–176694 (Taisei Corp).

*Primary Examiner*—Kenneth J. Dorner
*Assistant Examiner*—Cassandra Davis
*Attorney, Agent, or Firm*—Renner, Otto, Boisselle & Sklar, P.L.L.

[57] ABSTRACT

A display apparatus simulates a container of gaseous liquid. The display apparatus has a reservoir formed by closely spaced inner and outer walls, at least the outer wall being transparent or translucent and shaped to resemble the container. In use, a foamable liquid is held within the reservoir, and gas is introduced into the liquid at the bottom of the reservoir to thereby form bubbles which rise through the liquid and form a head of foam on the liquid. A foam regulating mechanism allows the gas from burst foam bubbles to escape from the reservoir, but returns the liquid component of burst foam bubbles to the reservoir. The display apparatus is suitable for simulating soda drinks, beer and other aerated beverages.

22 Claims, 13 Drawing Sheets

ANIMATED DISPLAY ASSEMBLY

AN ANIMATED DISPLAY ASSEMBLY

This invention relates to an animated display assembly.

This invention has particular but not exclusive application to a bubbling liquid display such as a carbonated beverage display or an aerated liquid display, and for illustrative purposes reference will be made to such application.

BACKGROUND ART

There are many difficulties associated with the provision of such display assemblies, depending upon the effect to be achieved. For example in a beverage sign it may be desired to simulate the rising bubbles as well as the head of foam which often forms on the surface of the beverage. In a simulated aerated water display it may also be necessary to maintain a clear liquid appearance in a closed cycle environment exposed to light. In practically all instances it is necessary to provide an arrangement which is not unduly heavy and which facilitates ease of manufacture, transport and maintenance as well as long term effectiveness.

The present invention aims to alleviate one or more of the above disadvantages and to provide a display assembly which will be reliable and efficient in use.

SUMMARY OF THE INVENTION

In one broad form, this invention provides display apparatus for simulating a container of gaseous liquid, comprising inner and outer walls at least partially defining a reservoir, the outer wall being at least light transmissive and shaped or contoured to resemble at least a portion of the container, the inner wall generally following the shape or contour of the outer wall but spaced inwardly therefrom, a foamable liquid contained, in use, in the reservoir, and aeration means for introducing gas into the liquid at a bottom portion of the reservoir to thereby form bubbles which rise through the liquid and form a head of foam in a space above the liquid, and foam regulating means for venting gas from burst foam bubbles but returning liquid component of the burst foam bubbles to the reservoir.

The reservoir may be an open reservoir which may be contained within a closed environment. Alternatively the reservoir may be a closed reservoir, or a substantially closed reservoir having an inlet and/or an outlet through which liquids and gases may pass.

The reservoir walls may be any suitable shape. For example, the reservoir may be shaped like a receptacle used for the purposes of drinking and/or storing beverages such as a drinking glass, a bottle or a can.

The reservoir walls may be constructed from any suitable material including plastics materials, acrylic materials or glass. Furthermore, the construction of the reservoir walls may be unitary or may comprise a plurality of sealably connected wall panels.

In order to minimise the volume of liquid contained in the reservoir without substantially affecting the external visual appearance of the reservoir, the opposing inner and outer walls of the reservoir may be narrowly separated, particularly in the line of sight.

In order to suppress the growth of mould and fungus, particularly on the internal surfaces of the assembly such as those of the liquid reservoir, the materials used in the construction of the assembly may include an anti-fungal additive and/or may be coated with an anti-fungal agent.

In order to create certain desired visual effects such as the colour of the beverage, portions of the reservoir may be coloured and/or there may be provided an appropriately coloured insert. Similarly, in order to create an illusion of depth, portions of the reservoir may be coated with a reflective material and/or the reservoir may include a reflective insert.

The liquid used to fill the reservoir is preferably stable at operating temperatures. For example, the liquid may have a relatively high flash point, a relatively high boiling point and/or a high temperature at which it will ignite. Preferably the liquid is an oil such as an iso-paraffin.

The liquid may be clear, or may be coloured naturally or by the addition of an appropriately coloured dye or colouring agent. For example, in the case of liquids used to simulate beers, a yellow or brown colouring agent may be added to the otherwise clear liquid. Similarly, a mixture of yellow, red and blue colouring agents may be added to the clear liquids used to replicate colas.

In the case of active liquids, an anti-fungal treatment may be added to the liquid so as to inhibit the growth of unsightly mould and fungus on the walls of the liquid reservoir.

The liquid may also include other agents which modify the characteristics of the liquid to suit the intended purpose, such as viscosity modifying agents to achieve a desired rate of ascent of bubbles in the liquid.

A foaming agent, such as a detergent, may also be added to the liquid in order to facilitate the formation of foam.

The aeration means for producing bubbles in the liquid may include an air pump pumping air to a distribution manifold in the liquid.

The liquid entrained in the bubbles may be recovered by a conventional separation process such as a centrifuge, the use of filters or by allowing the bubbles to pass to a settling tank communicating with the reservoir.

The display assembly may also include illuminating means for illuminating the reservoir or at least a portion thereof, such as the upper portion, and/or the liquid contained therein. For example the illuminating means may comprise a light source, such as a fluorescent light, and surfaces adapted to reflect the light on selected portions of the reservoir or arranged such that light may be refracted by the surface of the bubbles and thereby illuminate the liquid.

The display assembly may also include signage means on which promotional or advertising means may be displayed or carried. The promotional means may be integral with or releasably attached to the reservoir. The reservoir may be supplied as a separate functional display unit, possibly including mounting means, whereby the unit may be mounted on or otherwise adjacent to signage means such as a wall bearing advertising and/or promotional material. Alternatively, the signage means may include a portion of the reservoir.

For the purposes of transporting the display assembly, the display assembly may be provided with closure means adapted to close any inlets and/or outlets pertaining to the reservoir. For example, the reservoir may include an air inlet and an air outlet which may be closed by respective solenoid valves which open only when power is provided to the display means.

A suitable liquid for simulating a cola, comprises:

an iso-paraffin oil, and an appropriately coloured wax based tint.

Preferably the wax based tint includes a mixture of yellow, red and blue coloured tints.

For example, the liquid may comprise the following:

1. Spindle oil (clear) 5 litre
2. Yellow dye solution 50 mls
3. Red dye solution 20 mls
4. Blue dye solution 10 mls The amounts referred to above may be varied in order to adjust the colour of the resulting liquid.

In order to produce the yellow, red and blue dye solutions, the following may be used:

1. Yellow dye powder - Waxoline Yellow GFW
2. Red dye powder - Waxoline Red O
3. Blue dye powder - Waxoline Blue APFW The above powders are made up into concentrated solutions as follows.

To make "yellow dye solution", 1 gram of Waxoline Yellow GFW may be added to 400 mls of Spindle Oil and stirred. Preferably this solution is well stirred before each use as it tends to settle out.

To make "red dye solution", 1 gram of Waxoline Red O may be combined with 100 mls of Spindle Oil and well stirred.

To make "blue dye solution", 1 gram of Waxoline Blue APFW may be combined with 100 mls of Spindle Oil and well stirred.

In order that this invention may be more readily understood and put into practical effect, reference will now be made to the accompanying drawings which illustrate a typical embodiment of the invention.

DESCRIPTION OF PREFERRED EMBODIMENT

Figure 1:
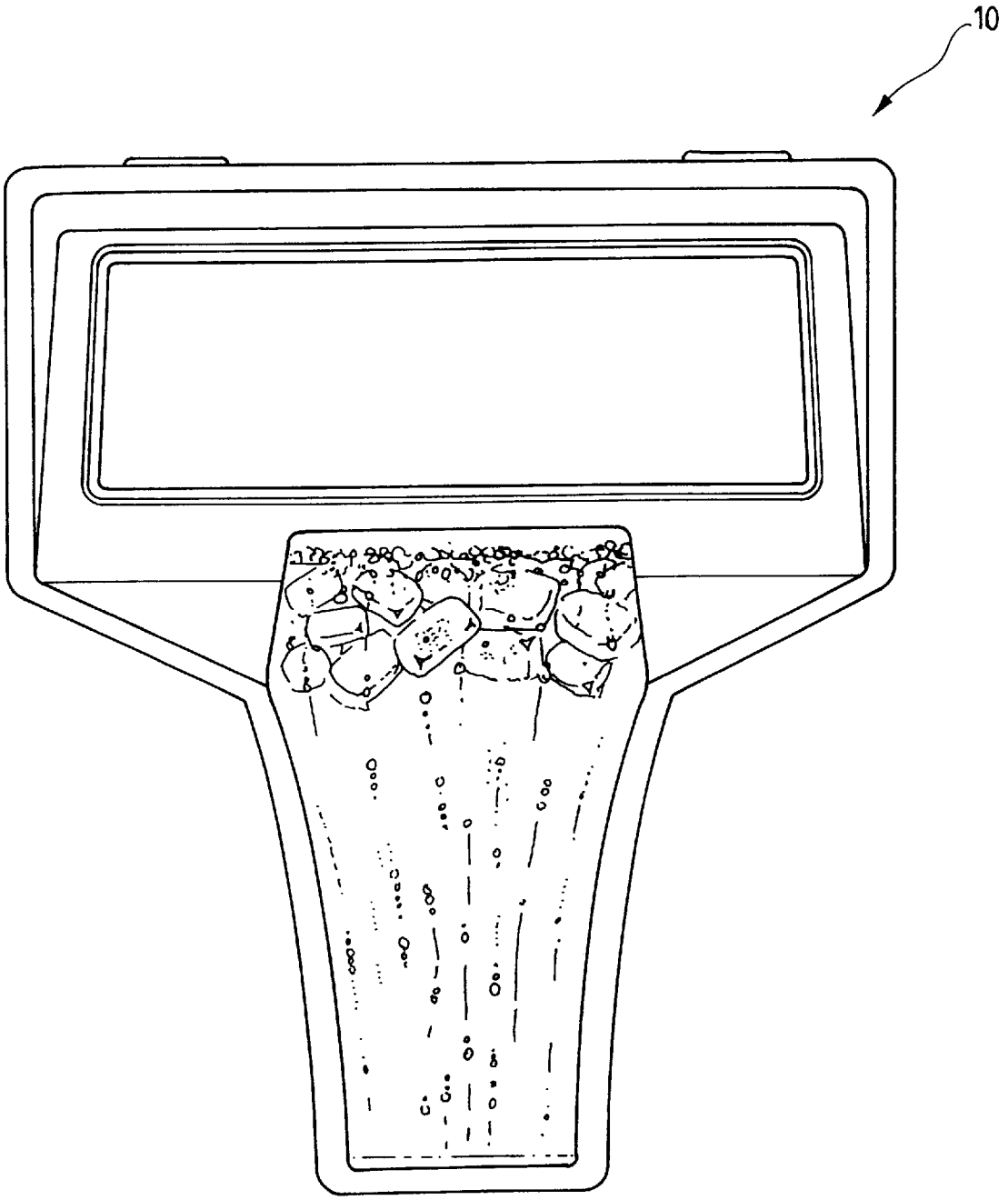
FIG. 1 is a front view of a display assembly constructed in accordance with the present invention.
Figure 2:
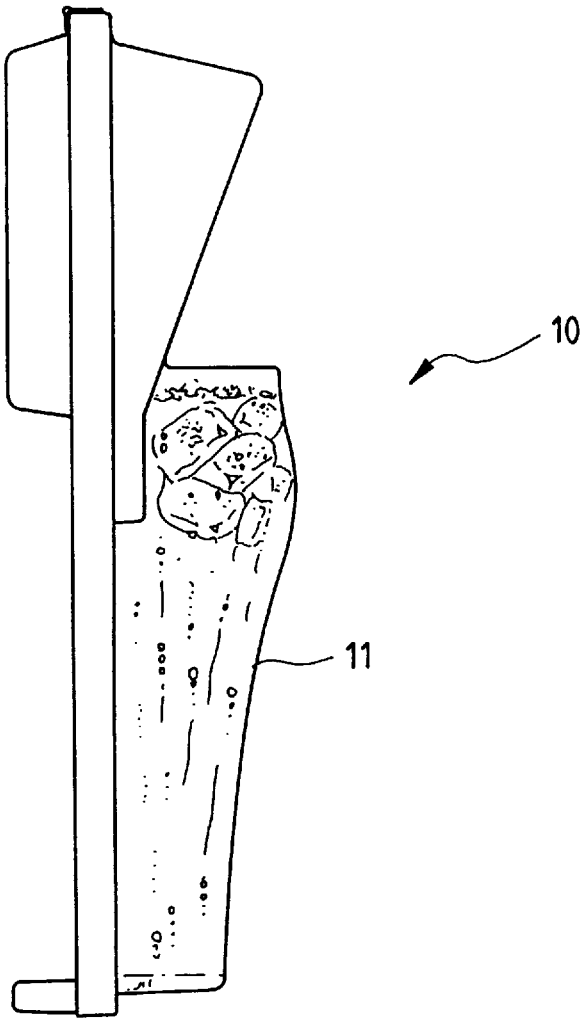
FIG. 2 is a side view of the display assembly illustrated in FIG. 1.
Figure 3:
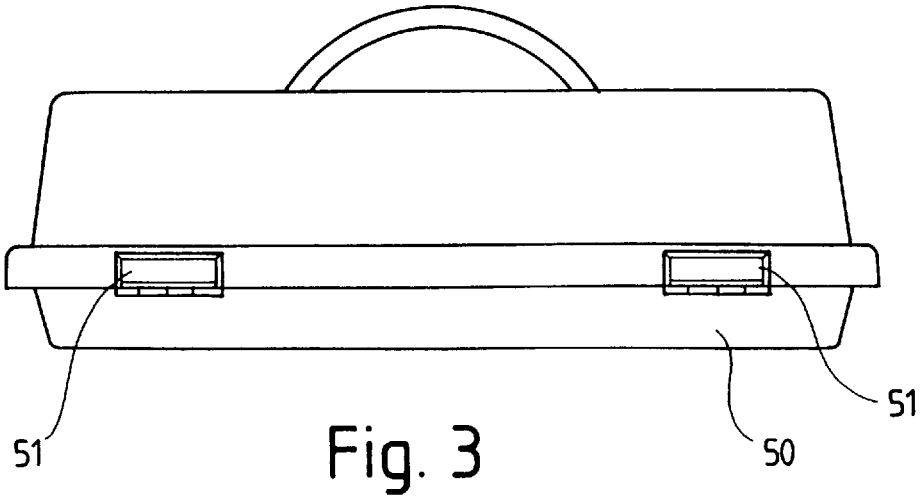
FIG. 3 is a plan view of the display assembly illustrated in FIG. 1.
Figure 4:
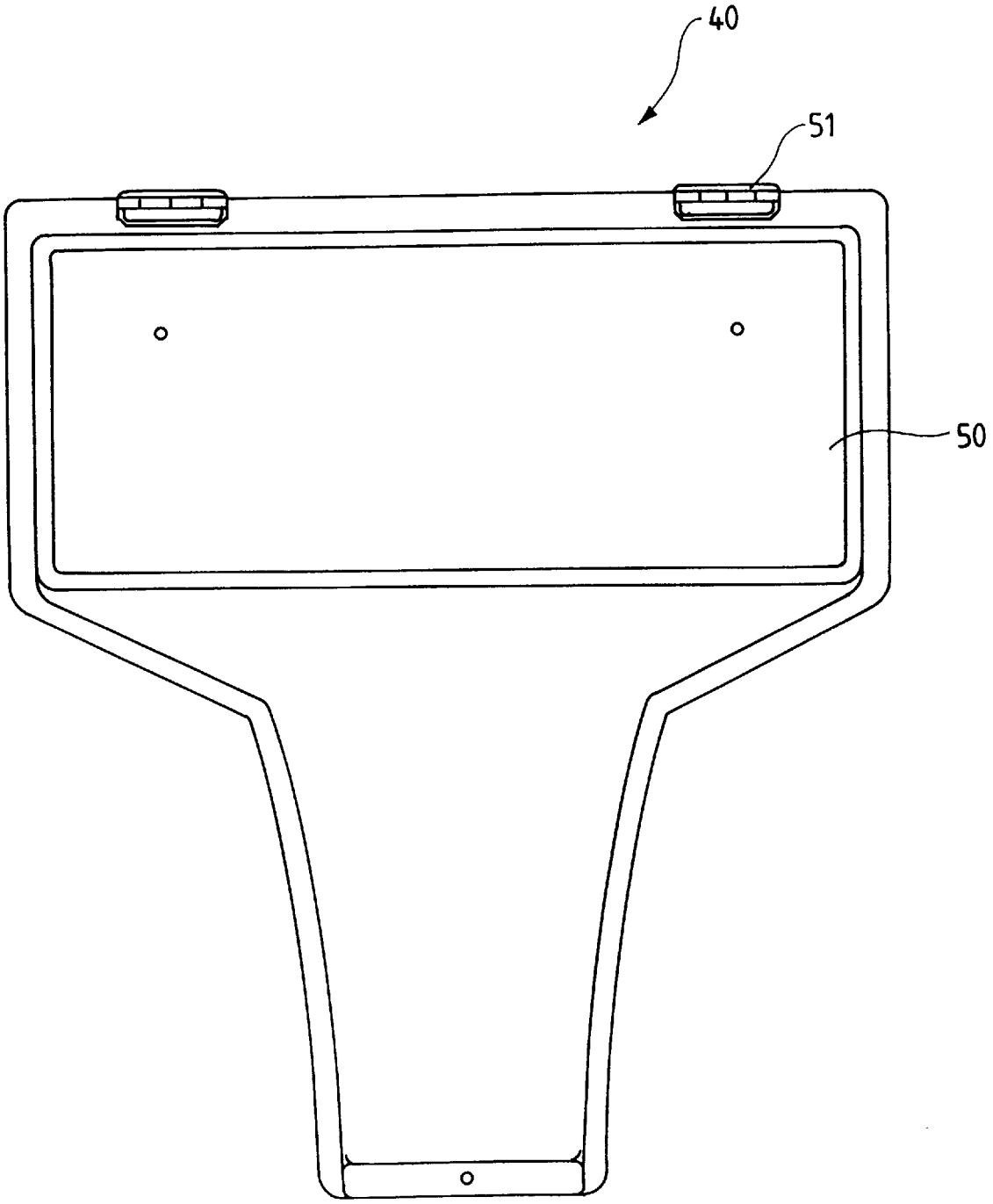
FIG. 4 is a rear view of the display assembly illustrated in FIG. 1.
Figure 5:
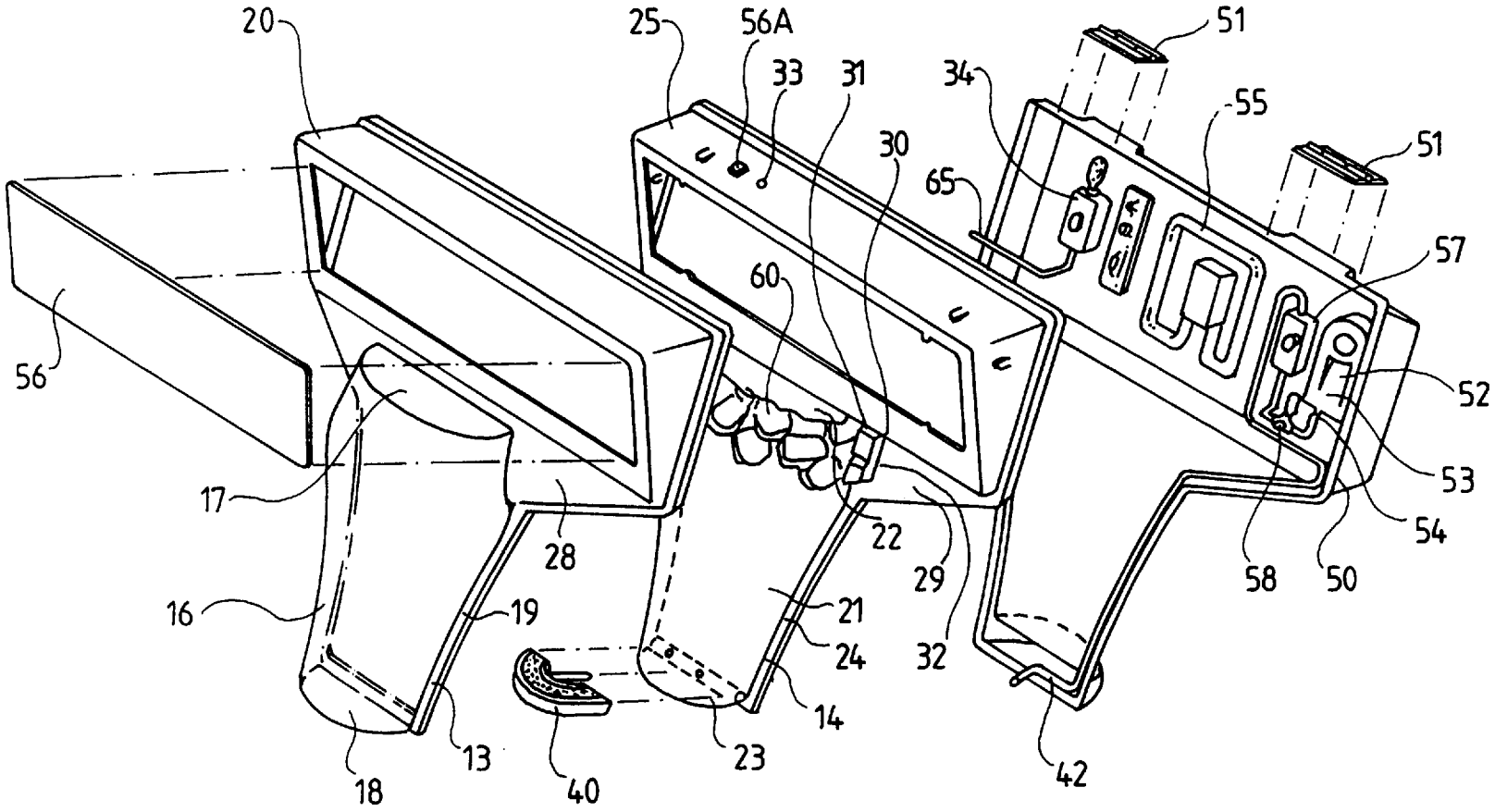
FIG. 5 is a perspective view of the display assembly illustrated in FIG. 1, the display assembly being shown in part for assembly.
Figure 6:
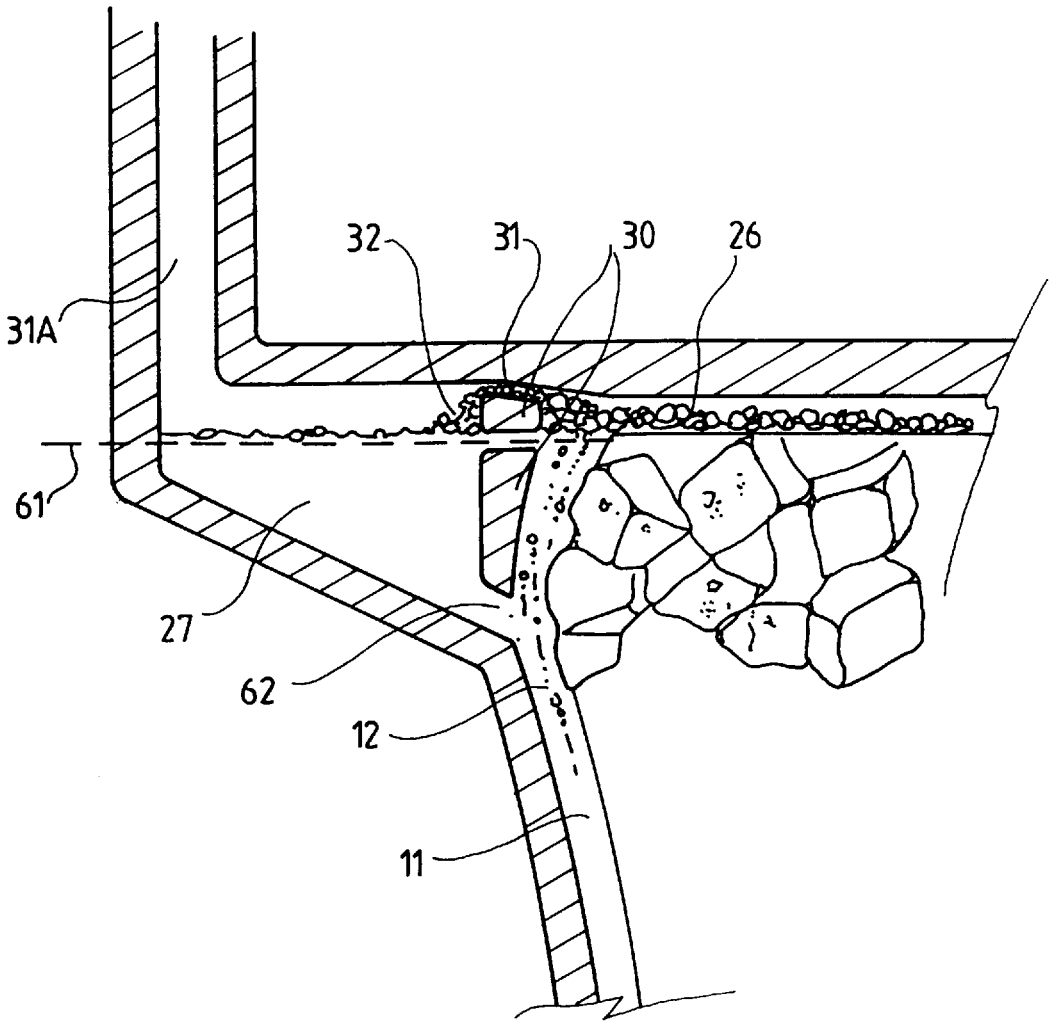
FIG. 6 is a front cross-sectional view of the display assembly illustrated in FIG. 1.
Figure 7:
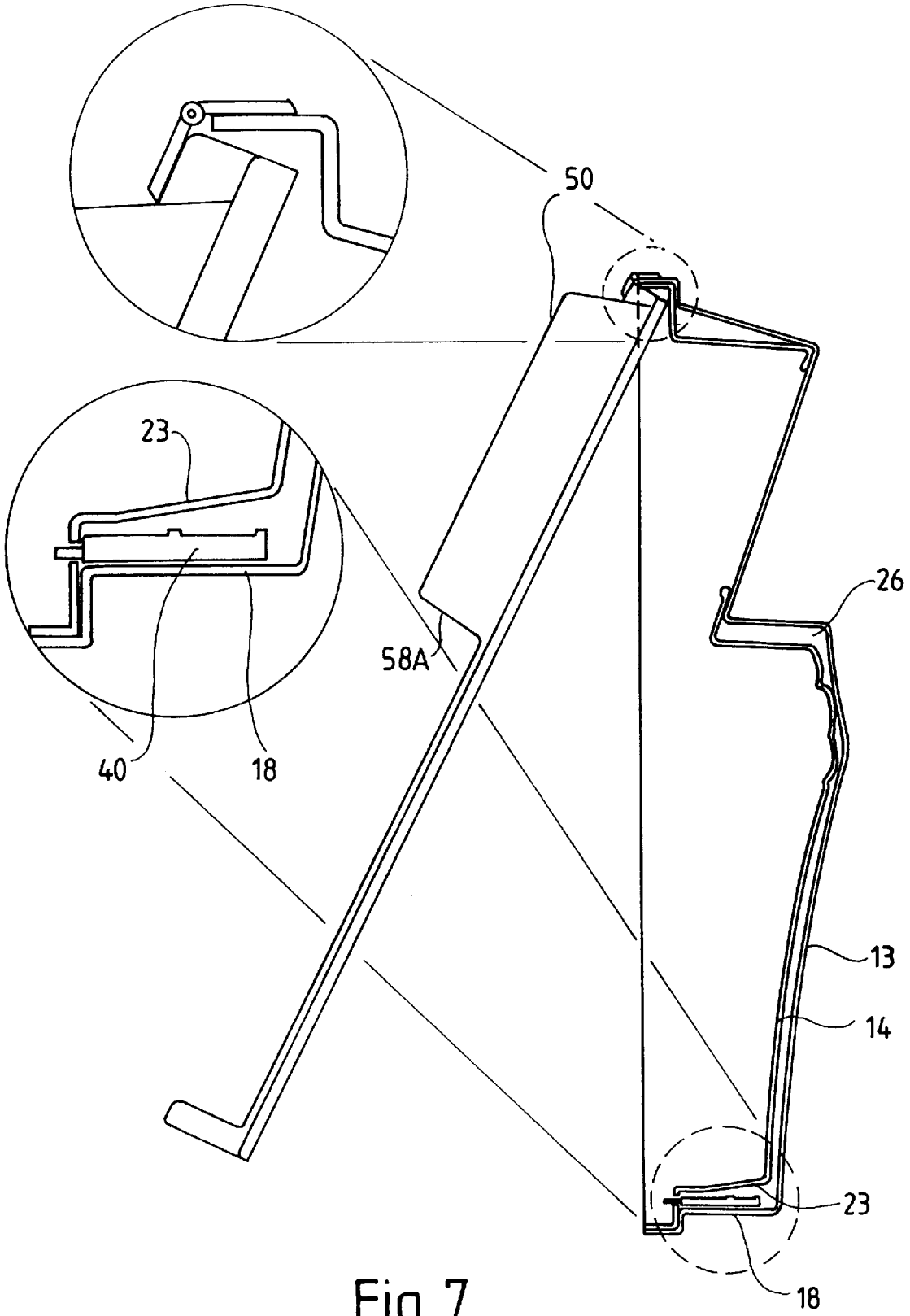
FIG. 7 is a side cross-sectional view of the display assembly illustrated in FIG. 1.
Figure 8:
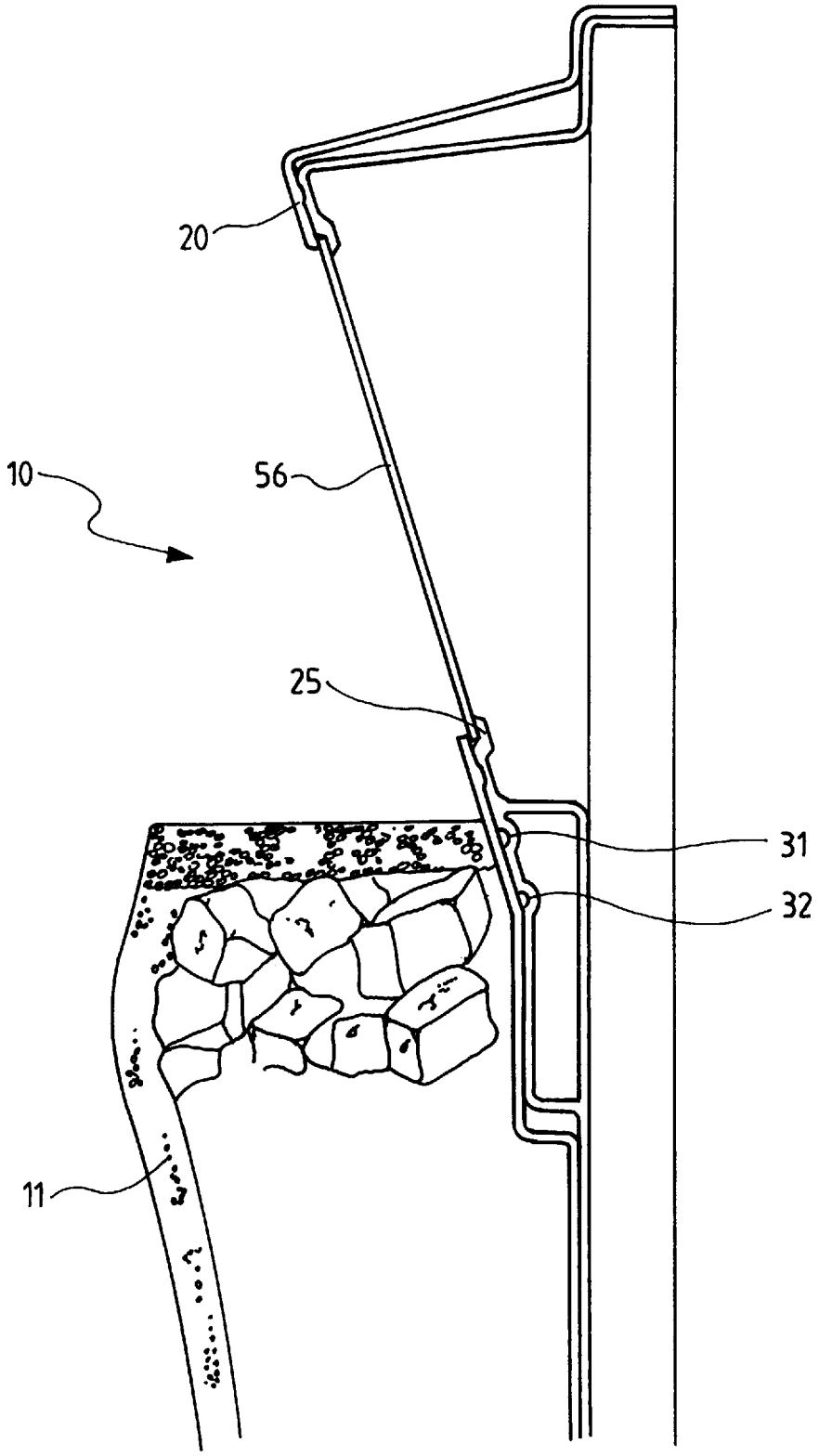
FIG. 8. is a side cross-sectional view of the display assembly illustrated in FIG. 1.
Figure 9:
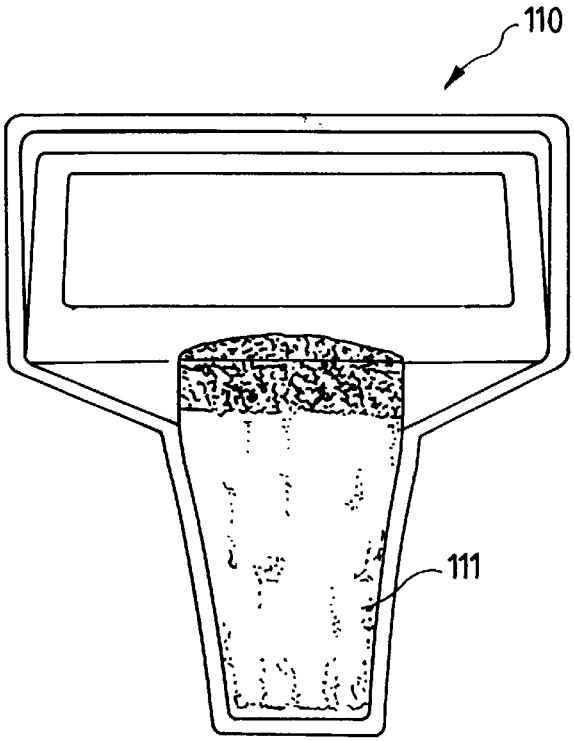
FIG. 9 is a front view of another display assembly constructed in accordance with the present invention.
Figure 10:
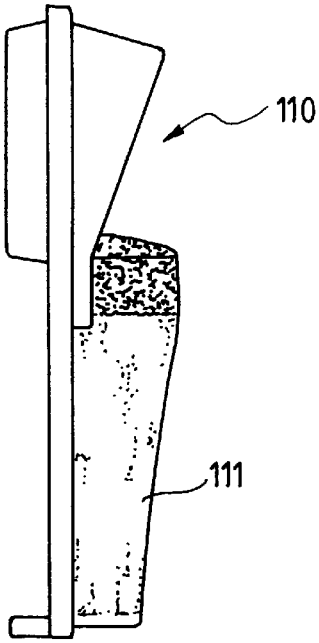
FIG. 10 is a side view of the display assembly illustrated in FIG. 9.
Figure 13:
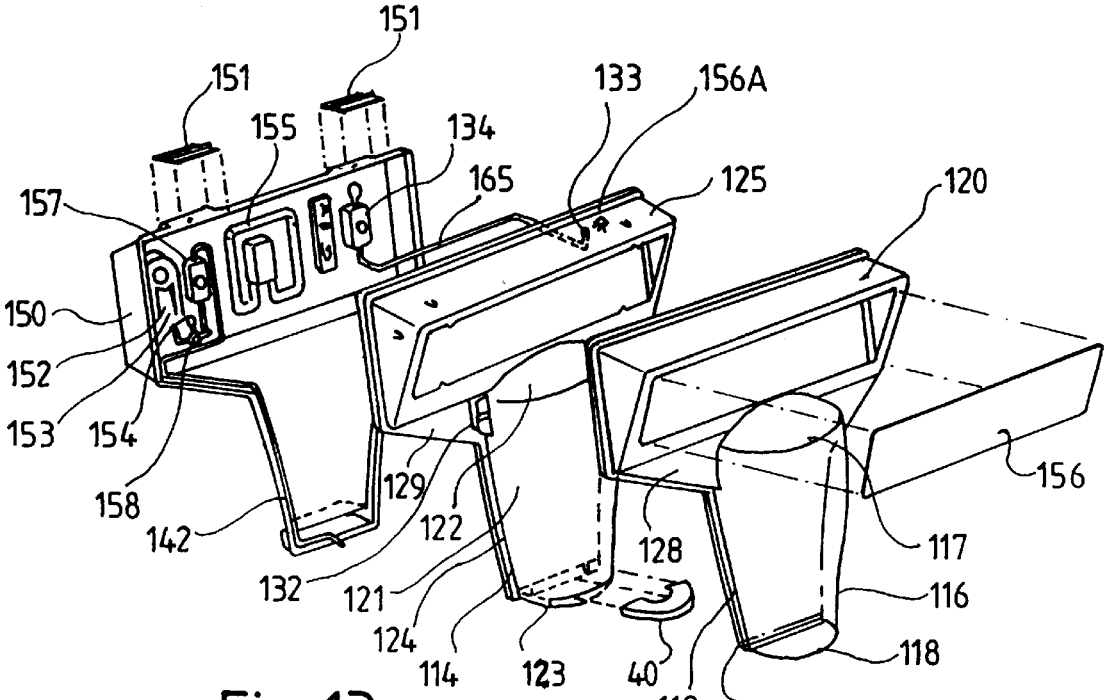
FIG. 13 is a perspective view of the display assembly illustrated in FIG. 9, the display assembly being shown in part for assembly.
Figure 11:
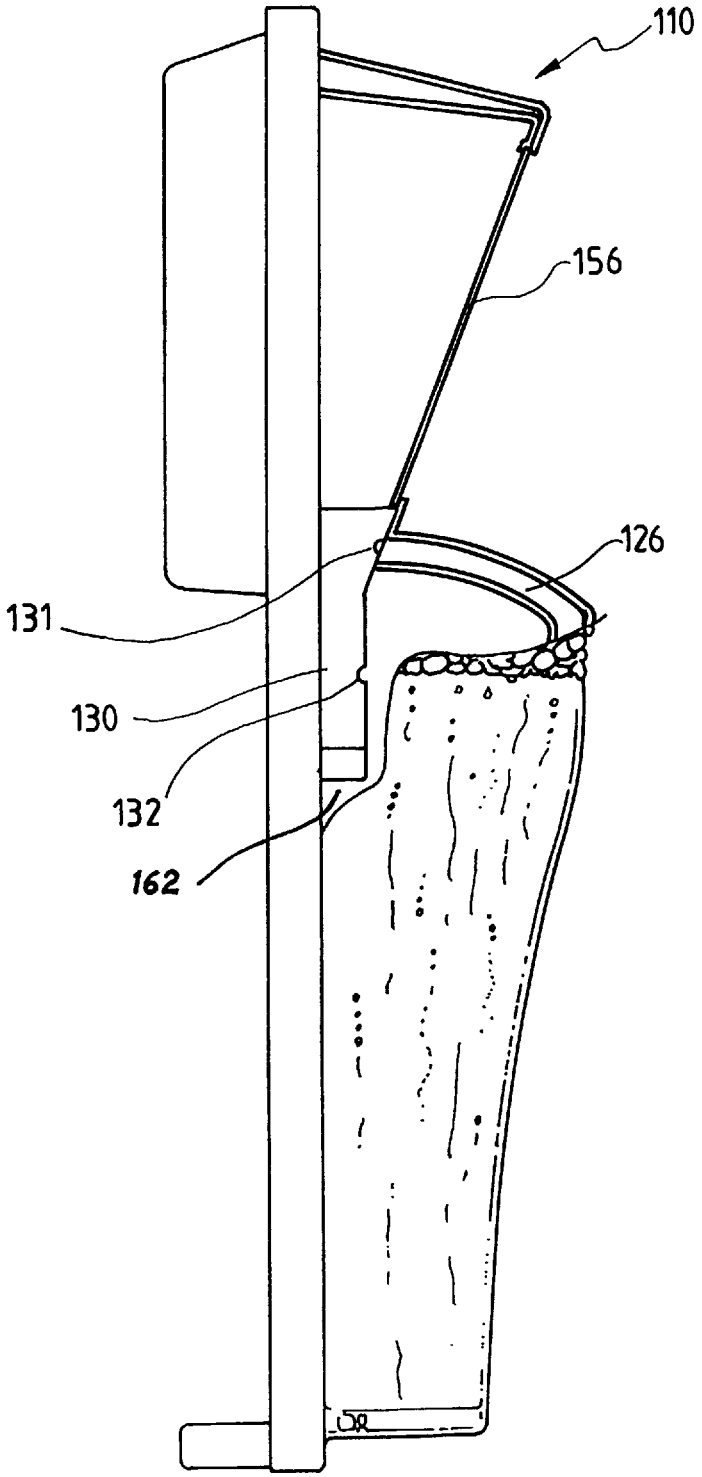
FIG. 11 is a side cross-sectional view of the display assembly illustrated in FIG. 9.
Figure 12:
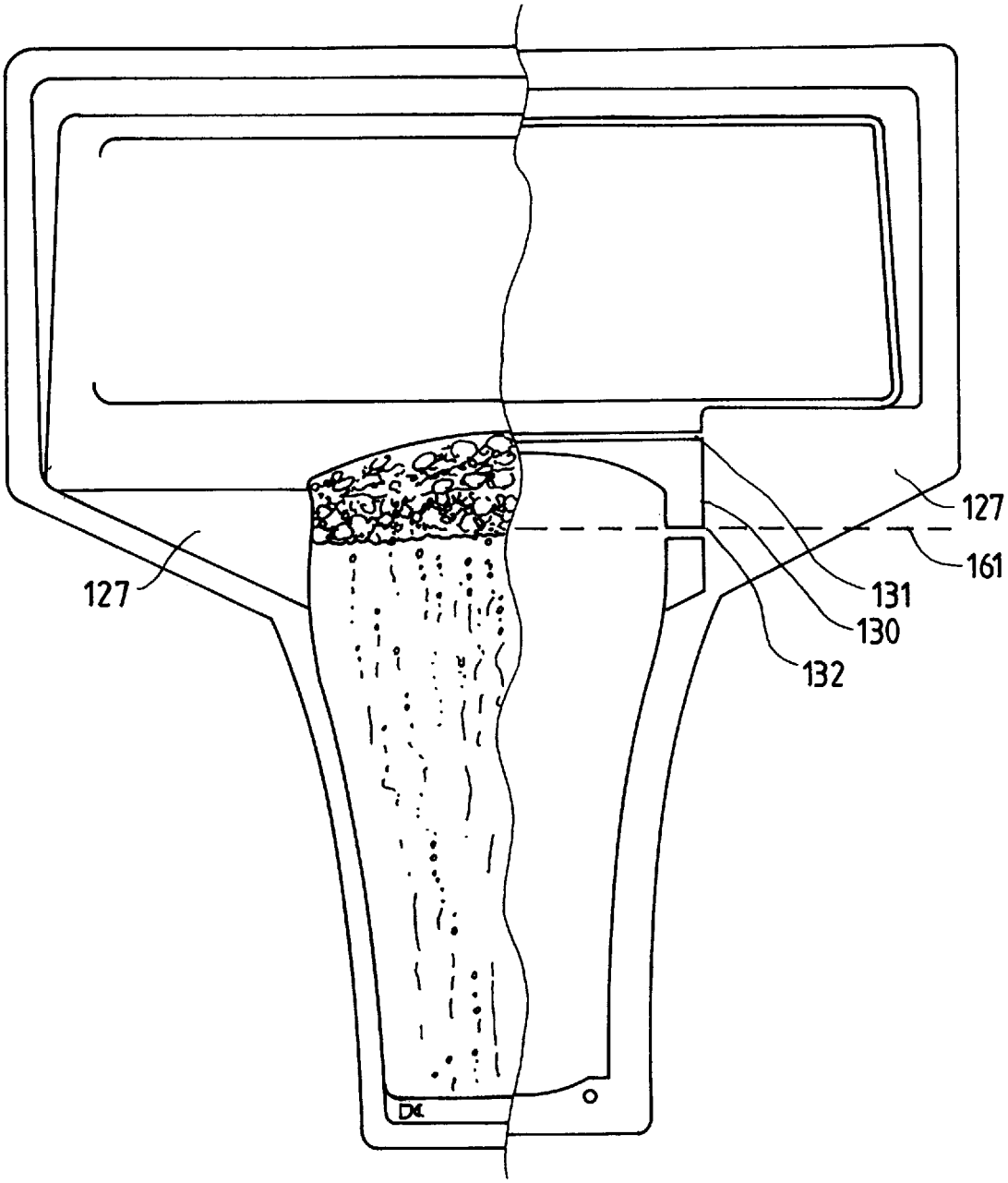
FIG. 12 is a front cross-sectional view of the display assembly illustrated in FIG. 9.
Figure 15:
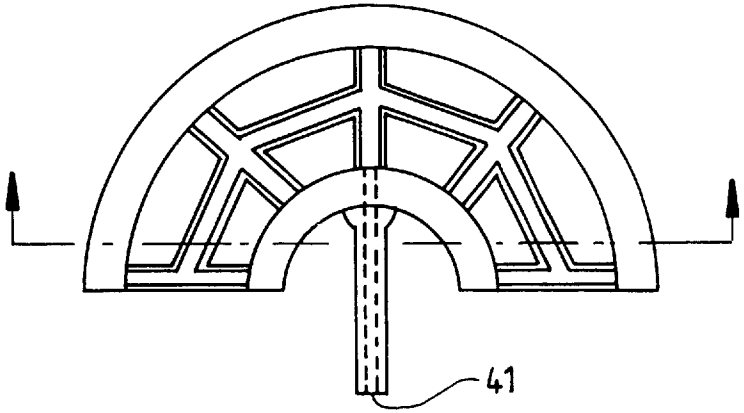
FIG. 15 is a plan view of the distribution manifold illustrated in FIG. 14.
Figure 16:
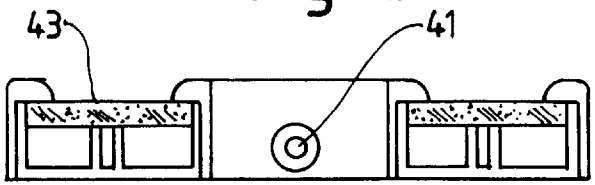
FIG. 16 is a rear cross-sectional view of the distribution manifold illustrated in FIG. 14.
Figure 14:
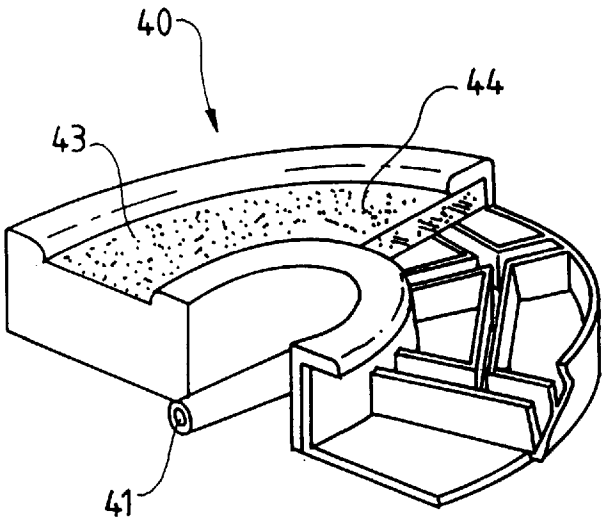
FIG. 14 is a perspective view of a distribution manifold with a portion shown cut away.

FIGS. 1 to 8 illustrate a display assembly 10 adapted to depict a carbonated beverage such as a cola. The display assembly comprises a reservoir 11 which is partially filled with an iso-paraffin oil 12, which will produce a foam when air is pumped therethrough. Yellow, blue and red coloured wax based tints have been added to the oil 12 to replicate the colour of the beverage.

The reservoir 11 when viewed front on is shaped like a drinking glass and includes a front wall panel 13 and an opposing, dimensionally slightly smaller, rear wall panel 14, both of which are manufactured from a plastics material, an acrylic material or an acrylicpolymer blended material.

The front wall panel 13 includes a curved front (or outer) wall 16, a top wall 17, a base wall 18, a coplanar circumferential flange 19 and an upper message portion 20.

The rear wall panel 14 also includes a curved rear (or inner) wall 21, a top wall 22, a base wall 23, a coplanar circumferential flange 24 and an upper rear message portion 25.

The front wall panel 13 and the rear wall panel 14 are assembled such that the latter nests within the former forming a cavity therebetween. The two abutting flanges 19 and 24 are sealably connected using a sonic welding, heat welding or an adhesive process.

The resulting cavity comprises a lower chamber or reservoir 11 defined by opposing walls 16 and 21; and an upper chamber or space 26 in which foam may generally collect, being defined by opposing top walls 17 and 22. The cavity also includes two lateral chambers 27, located on the right and the left of the lower chamber 11, the lateral chambers being defined by opposing wall portions 28 and 29 of the front and rear wall panels 13 and 14 respectively.

The lateral chambers 27 are separated from the reservoir 11 and the foam collection chamber 26 by a dividing wall 30 formed in the rear wall panel 14, communication between the respective chambers being by way of channels or ducts 31 and 32 formed in the wall 30.

The front and rear message portions 20 and 25 also nest one within the other and, when assembled, establish a chamber or pressure equalization zone 31A connecting the two lateral chambers 27. The top wall of the rear message portion 25 includes an outlet aperture 33 through which air, having previously been introduced to the cavity, may pass. The outlet 33 is connected to an air exit solenoid valve 34.

The assembly also includes a semi-circular shaped distribution manifold or insert 40 which is located intermediate the opposing bottom walls 18 and 23 of the assembled front and rear wall panels 13 and 14. The distribution manifold includes an air inlet 41 projecting rearwardly therefrom, to which a feed tube 42 may be releasably attached, and a plurality of air outlet apertures 43 formed in the recessed top wall 44.

The assembly 10 also includes a rear panel 50 which is hingedly connected to the assembled front and rear wall panels 13 and 14 by way of hinges 51. The rear panel 50 provides both mounting means and a housing for aeration means.

The aeration means for producing bubbles in the liquid includes an air pump 52 having an air inlet 53 and an air outlet 54 which is connected to a feed tube 42. The air inlet 53 of the pump 52 may be provided with filtration means such as a charcoal filter, not shown, which may be adapted to remove impurities from the air which may otherwise contaminate the fluid in the reservoir.

The display assembly also includes illumination means such as a fluorescent light 55 positioned behind the message portions 20 and 25, and which is adapted to illuminate the message panel 56, releasably retained therebetween, and the reservoir 11.

The assembly may also be provided with level detection means such as a mercury switch 56A operatively connected to the power source for the display assembly, such that power to both the pump 52 and the fluorescent light 55 is supplied only whilst the display assembly i.e. the reservoir, is maintained in an upstanding level attitude.

Furthermore, in addition to the air outlet solenoid valve 34, there is also provided an air inlet solenoid valve 57 fitted to the air inlet. Both valves are closed except when electrically activated. The quantity of bubbles produced by the air pump may be selectively controlled by controlling the volume of air passing through a 3-way air bleed off valve 58.

The internal surface of the rear panel 50 may be coloured by paint, vinyl adhesive or a reflective material to depict a particular background colour to enhance visuals of any beverage or scene. For example, in the case of an assembly used to depict a cola, the internal surface of the rear panel is painted a dark colour such as black.

The rear panel 50 also includes a plurality of ventilation apertures situated at top and base of the recessed section thereof.

It will also be appreciated that the shape of the rear panel 50 may be utilised to regulate illumination dispersement. For example, by varying the angle of inclination of wall 58A, it is possible to vary the extent of light passing to the lower portions of the reservoir.

In use, the reservoir is filled with a foamable liquid resembling a cola to a level generally indicated by the dotted line 61. The distribution manifold 40 is of coloured or clear construction to replicate the generally thicker base wall of most drinking vessels. Air or gas delivered by the pump 52, when actuated, will be released through apertures 43 in the form of bubbles. These bubbles travel vertically a short distance before collecting under the wall 23. Eventually however the accumulated bubbles will spill over the semi-circumferential edge of wall 23 and rise through the liquid contained in the reservoir 11. The bubbles accumulate on the surface of the liquid so as to form a head of foam.

The upper section of curved wall 21 is contoured to replicate the shape of a collection of ice pieces 60 which alter, but do not totally restrict, the passage of bubbles to the surface. These contours 60, when illuminated, refract light to give the illusion of floating pieces of ice in the reservoir 11.

The outer or external surface of the front wall 16, or at least portions thereof, may be roughened, such as may result from sand blasting same, so as to create a frosted effect reminiscent of condensation which typically forms on cold surfaces. Furthermore, in order to simulate droplets of condensation, droplets may be painted on the external surface of the front wall 16 or, alternatively, droplets of resin may be applied thereto.

The foam head will generally fill the upper chamber 26. Excess foam is conveyed into the lateral or settling chambers 27, via passageways 31, positioned on either side thereof. The bubbles contained in the settling chambers 27 eventually will burst releasing both air and liquid. The liquid collected in the settling chambers is returned to the reservoir via passageways 32 and 62 whilst the air released by the bursting bubbles is conveyed via the pressure equalization chamber 31, the aperture 33 and the flexible tubing 65, to the air outlet valve.

During use, the level of liquid contained in the reservoir is controlled by the simultaneous separation of the foam into liquid and air, and is generally constant.

The quantity of bubbles released into the reservoir by the aeration means may be selectively controlled using the three way bleed off valve 58 to control the volume of air passing to the distribution manifold 40.

The message panel 56 may be selectively removed. This permits the message to be changed if desired and allows access to wall mounted units for servicing purposes.

FIGS. 9 to 13 illustrate a display assembly 110 adapted to depict a glass of beer, comprising a liquid reservoir ill which is partially filled with an iso-paraffin oil, which will produce a foam when air is pumped therethrough, and to which an appropriately coloured wax based tint has been added so as to replicate the colour of the beverage.

The reservoir 111 when viewed front on is shaped like a drinking glass and includes a front wall panel 113 and an opposing, dimensionally slightly smaller, rear wall panel 114, both of which are manufactured from a translucent or transparent material such as a plastics material, an acrylic material or an acrylic-polymer blended material.

The front wall panel 113 includes a curved front (or outer) wall 116, a top wall 117, a base wall 118, a coplanar circumferential flange 119 and an upper message portion 120.

The rear wall panel 114 also includes a curved rear (or inner) wall 121, a top wall 122, a base wall 123, a coplanar circumferential flange 124 and an upper rear message portion 125.

The front wall panel 113 and the rear wall panel 114 are assembled such that the latter nests within the former forming a cavity therebetween. The two abutting flanges 119 and 124 are sealably connected using a sonic welding, heat welding or an adhesive process.

The resulting cavity comprises a lower chamber or reservoir 111, defined by opposing walls 116 and 121; and an upper chamber or space 126 in which foam may generally collect, being defined by opposing top walls 117 and 122. The cavity also includes two lateral chambers 127, located on the right and the left of the lower chamber 111, the lateral chambers being defined by opposing wall portions 128 and 129 of the front and rear wall panels 113 and 114 respectively.

The lateral chambers 128 are separated from the reservoir 111 and the foam collection chamber 126 by a dividing wall 130 formed in the rear wall panel 114, communication between the respective chambers being by way of channels or ducts 131 and 132 formed in the wall 130.

The front and rear message portions 120 and 125 also nest one within the other and, when assembled, establish a chamber or pressure equalization zone (not shown) connecting the two lateral chambers 127. The top wall of the rear message portion 125 includes an outlet aperture 133 through which air, having previously been introduced to the cavity, may pass. The outlet 133 is connected to an air exit solenoid valve 134.

The assembly also includes a semi-circular shaped distribution manifold or insert 40 (described above) which is located intermediate the opposing bottom walls 118 and 123 of the assembled front and rear wall panels 113 and 114. The distribution manifold includes an air inlet 41 projecting rearwardly therefrom, to which a feed tube 142 may be releasably attachedThe assembly 110 also includes a rear panel 150 which is hingedly connected to the assembled front and rear wall panels 113 and 114 by way of hinges 151. The rear panel 150 provides both mounting means and a housing for the aeration means.

The aeration means for producing bubbles in the liquid includes an air pump 152 having an air inlet 153 and an air outlet 154 which is connected to a feed tube 142. The air inlet 153 of the pump 152 may be provided with filtration means such as a charcoal filter, not shown, which may be adapted to remove impurities from the air which may otherwise contaminate the fluid in the reservoir.

The display assembly also includes illumination means such as a fluorescent light 155 positioned behind the message portions 120 and 125, and which is adapted to illuminate the message panel 156, releasably retained therebetween, and the reservoir 111.

The assembly may also be provided with level detection means such as a mercury switch 15GA operatively connected to the power source for the display assembly, such that power to both the pump 152 and the fluorescent light 155 is supplied only whilst the display assembly i.e. the reservoir, is maintained in an upstanding level attitude.

Furthermore, in addition to the air outlet solenoid valve 134, there is also provided an air inlet solenoid valve 157 fitted to the air inlet. Both valves are closed except when electrically activated. The quantity of bubbles produced by the air pump may be selectively controlled by controlling the volume of air passing through a 3 way air bleed off valve 158.

The internal surface of the rear panel 150 may be coloured by paint, vinyl adhesive or a reflective material to depict a particular background colour to enhance visuals of any beverage or scene. For example, in the case of an assembly used to depict a beer, the internal surface of the rear panel is painted a colour which is similar to that of the beer being depicted.

The rear panel 150 also includes a plurality of ventilation apertures situated at top and base of the recessed section thereof.

In use, the reservoir is filled with a foamable liquid resembling a beer to a level generally indicated by the dotted line 161. Air or gas delivered by the pump 152, when actuated, will be released through apertures 43 in the form of bubbles. These bubbles travel vertically a short distance before collecting under the wall 123. Eventually however the accumulated bubbles will spill over the semi-circumferential edge of wall 123 and rise through the liquid contained in the reservoir 111. The bubbles will then accumulate on the surface of the liquid so as to form a head of foam.

The outer or external surface of the front wall 116 or at least portions thereof, may be roughened, such as may result from sand blasting same, so as to create a frosted effect reminiscent of condensation which typically forms on cold surfaces. Furthermore, in order to simulate droplets of condensation, droplets may be painted on the external surface of the front wall 116 or, alternatively, droplets of resin may be applied thereto.

The foam head will generally fill the upper chamber 126. Excess foam is conveyed into the lateral or settling chambers 127, via passageways 131, positioned on either side thereof. The bubbles will either burst whilst being forced into the passageways 131 or once deposited into the settling chambers 127 thereby releasing both air and liquid. The liquid collected in the settling chambers is returned to the reservoir via passageways 132 and 162 whilst the air released by the bursting bubbles is conveyed via the pressure equalisation chamber, the aperture 133 and the flexible tubing 165, to the air outlet valve.

During use, the level of liquid contained in the reservoir is controlled by the simultaneous separation of the foam into liquid and air, and is generally constant.

The quantity of bubbles released into the reservoir by the production means may be selectively controlled using the three-way bleed off valve 158 to control the volume of air passing to the distribution manifold 40.

Figure 18:
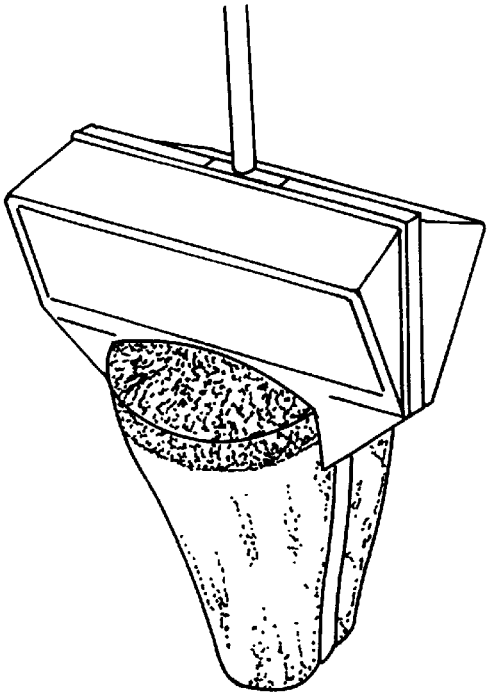
FIG. 18 is a perspective view of the display assembly illustrated in FIG. 17.
Figure 17:
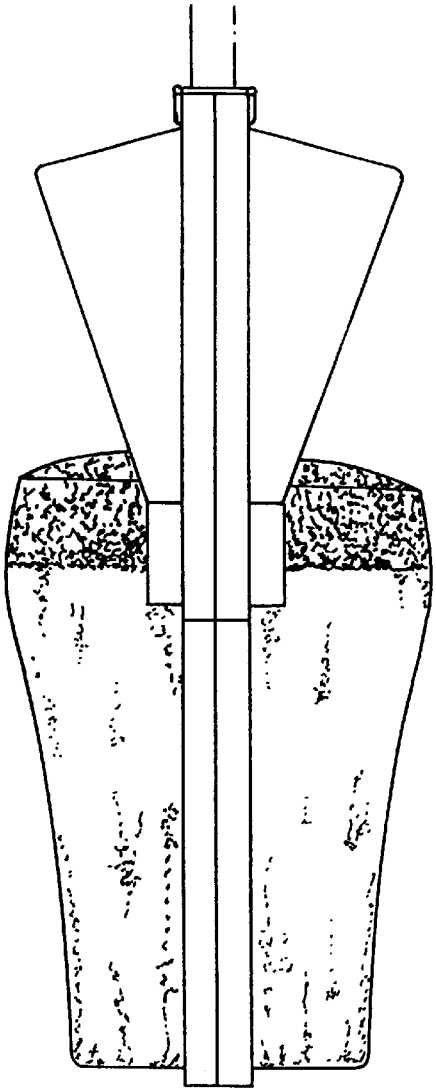
FIG. 17 is a side view of yet another display assembly constructed in accordance with the present invention.

In other embodiments a flat rear panel of the type described may also be used between two display assemblies mounted back to back as illustrated in FIGS. 17 and 18.

Figure 19:
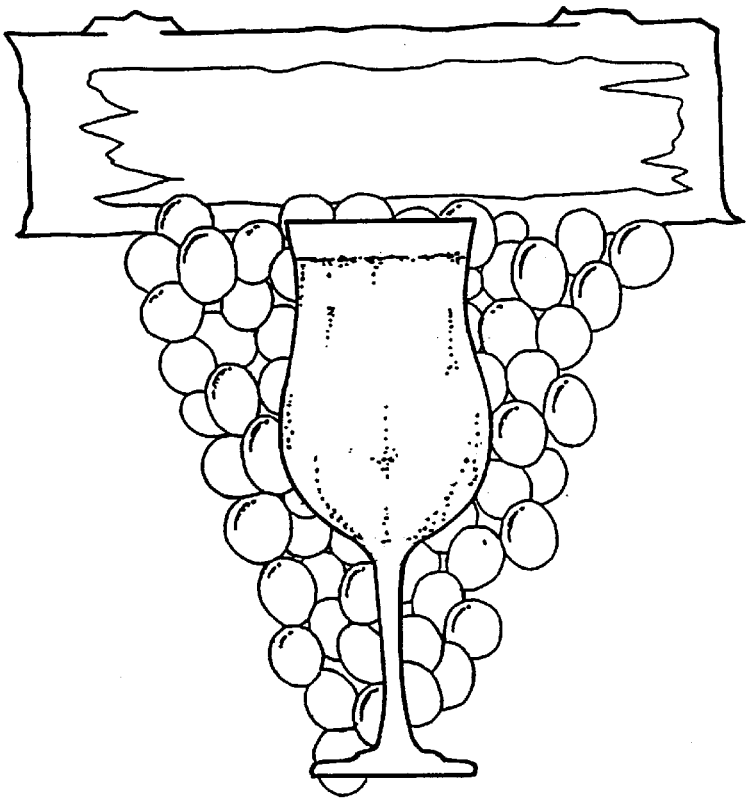
FIG. 19 is a front view of yet another display assembly constructed in accordance with the present invention.
Figure 20:
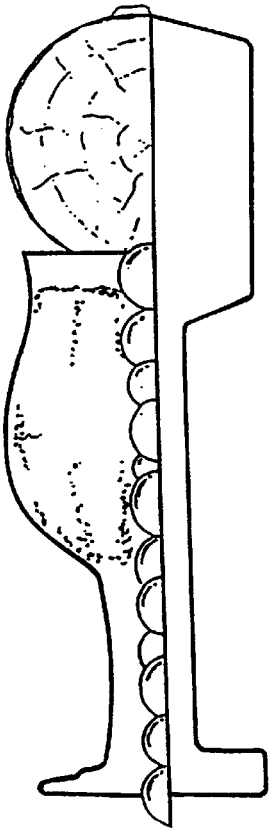
FIG. 20 is a side view of the display assembly illustrated in FIG. 19.

FIGS. 19 and 20 illustrate yet another display assembly 200 which may be used to depict beverages such as wines.

The display assemblies described herein provide a more realistic impression of a freshly poured glass of cola or beer.

We claim:

1. Display apparatus for simulating a container of gaseous liquid, comprising inner and outer walls at least partially defining a reservoir, the outer wall being at least light transmissive and shaped or contoured to resemble at least a portion of the container, the inner wall generally following the shape or contour of the outer wall but spaced inwardly therefrom, a foamable liquid contained, in use, in the reservoir, and aeration means for introducing gas into the liquid at a bottom portion of the reservoir to thereby form bubbles which rise through the liquid and form a head of foam in a space above the liquid, and foam regulating means for venting gas from burst foam bubbles but returning liquid component of the burst foam bubbles to the reservoir.

2. Display apparatus as claimed in claim 1, wherein the inner and outer walls are narrowly spaced in the direction normal to the walls.

3. Display apparatus as claimed in claim 2, wherein the spacing between the inner and outer walls is substantially constant.

4. Display apparatus as claimed in claim 1, wherein the liquid is an iso-paraffin oil.

5. Display apparatus as claimed in claim 1, wherein the liquid contains a foaming agent.

6. Display apparatus as claimed in claim 1, wherein the liquid is coloured.

7. Display apparatus as claimed in claim 1, wherein the liquid contains a viscosity modifying agent.

8. Display apparatus as claimed in claim 1, wherein the reservoir contains an anti-fungal agent.

9. Display apparatus as claimed in claim 1, wherein the container is in the form of a drinking vessel.

10. Display apparatus as claimed in claim 9, wherein the inner wall is shaped or contoured at an upper portion thereof to simulate pieces of ice which alter the course of at least some of the bubbles.

11. Display apparatus as claimed in claim 1, wherein the inner and outer walls form part of a respective one of a pair of nesting thermomoulded plastics panels.

12. Display apparatus as claimed in claim 1, wherein the foam regulating means comprises at least one chamber adjacent the reservoir and in fluid communication with the space via at least one duct, such that bubbles formed in the space may pass into the chamber, the chamber having an outlet permitting air from burst foam bubbles to escape therefrom and also being in fluid communication with the reservoir whereby liquid from burst bubbles may flow back into the reservoir.

13. Display apparatus as claimed in claim 12, comprising a pair of said chambers located on opposite sides of the reservoir, the chambers also being in fluid communication with each other via a pressure equalisation chamber.

14. Display apparatus as claimed in claim 13, wherein the pressure equalisation chamber is vented to the atmosphere via valve means.

15. Display apparatus as claimed in claim 14, wherein the valve means is electrically controlled.

16. Display apparatus as claimed in claim 1, wherein the aeration means comprises an air pump having an outlet connected to a distribution manifold located in the bottom portion of the reservoir.

17. Display apparatus as claimed in claim 16 further comprising valve means interposed between the air pump outlet and the distribution manifold.

18. Display apparatus as claimed in claim 17, wherein the valve means is electrically controlled.

19. Display apparatus as claimed in claim 16, wherein a bottom portion of the inner wall is shaped to form an inverted ledge above the distribution manifold, whereby in use, bubbles produced by air passing through the distribution manifold accumulate under the ledge before spilling over an edge thereof and rising through the reservoir.

20. Display apparatus as claimed in claim 1, further comprising an advertising or message panel formed above the reservoir and having illumination means, said illumination means also directing light onto the liquid and bubbles formed therein.

21. Display apparatus as claimed in claim 12 wherein the duct is located a predetermined distance above the liquid in the reservoir to permit a head of foam to be formed thereon.

22. Display apparatus as claimed in claim 1 wherein the liquid has a high boiling temperature and a high ignition temperature relative to its operating temperature.

* * * * *